US011878225B2

(12) United States Patent
Shelton, Jr.

(10) Patent No.: US 11,878,225 B2
(45) Date of Patent: Jan. 23, 2024

(54) BASEBALL PITCHING TRAINING DEVICE

(71) Applicant: William Henry Shelton, Jr., Mechanicsville, VA (US)

(72) Inventor: William Henry Shelton, Jr., Mechanicsville, VA (US)

( * ) Notice: Subject to any disclaimer, the term of this patent is extended or adjusted under 35 U.S.C. 154(b) by 0 days.

(21) Appl. No.: 17/300,902

(22) Filed: Dec. 14, 2021

(65) Prior Publication Data

US 2023/0181986 A1 Jun. 15, 2023

(51) Int. Cl.

| | |
|---|---|
| ***A63B 69/00*** | (2006.01) |
| ***A63B 43/00*** | (2006.01) |
| *A63B 102/18* | (2015.01) |

(52) U.S. Cl.

CPC ..... *A63B 69/0002* (2013.01); *A63B 43/008* (2013.01); *A63B 2069/0006* (2013.01); *A63B 2102/18* (2015.10)

(58) Field of Classification Search

CPC ..... A63B 69/0002; A63B 43/008; A63B 2102/18; A63B 2069/0006

USPC ..... 473/451, 422

See application file for complete search history.

(56) References Cited

U.S. PATENT DOCUMENTS

| | | | | | |
|---|---|---|---|---|---|
| 2,925,273 | A * | 2/1960 | Pratt | A63B 69/0002 | 473/451 |
| 3,110,494 | A * | 11/1963 | Morgan | A63B 69/0002 | 473/458 |
| 5,407,193 | A * | 4/1995 | McGinley | A63B 43/00 | 473/451 |
| 5,607,152 | A * | 3/1997 | Strassburger | A63B 69/0002 | 473/451 |
| 5,743,808 | A | 4/1998 | Barth | | |
| 5,820,497 | A | 10/1998 | Howland | | |
| 6,663,519 | B2 | 12/2003 | Kuhn | | |
| 7,059,862 | B2 * | 6/2006 | McGinley | A63B 69/0002 | 434/247 |
| 7,244,197 | B1 | 7/2007 | Kucek | | |
| 7,247,106 | B1 | 7/2007 | Brandt | | |
| 7,563,183 | B2 | 7/2009 | Kucek | | |
| 9,149,698 | B2 * | 10/2015 | Spiegler | A63B 37/12 | 473/451 |
| 9,149,699 | B2 * | 10/2015 | Tai | A63B 69/0002 | 473/451 |
| 2015/0314182 | A1 * | 11/2015 | Kasdorf | A63B 37/12 | 473/451 |

* cited by examiner

*Primary Examiner* — Mitra Aryanpour

(57) ABSTRACT

A baseball pitching training device used to instruct the throwing of a fastball, curveball, and change-up by a right handed pitcher through indicia placement on the baseball cover while maintaining the structural integrity of the baseball. The indicia provide finger alignment to grip the baseball needed to throw the desired pitch used in the sport of baseball. Correct finger alignment allows the baseball to sit in the right hand supported by the thumb, and non grip finger(s) to throw the chosen baseball pitch.

4 Claims, 3 Drawing Sheets

BASEBALL PITCHING TRAINING DEVICE

BACKGROUND

Field

This application relates to baseball sports training, specifically to an improved training baseball for right handed pitchers to enhance pitching skills.

Prior Art

In the sport of baseball there are pitches thrown by a right handed pitcher to improve pitching skills. Pitching skills are improved by mastering various pitches through learning pitch specific grips for throwing a baseball. Baseball pitching grips can be learned by having a baseball pitching training device where finger placement with correct finger alignment is shown on the baseball.

With the goal of teaching a right handed pitcher how to throw various baseball pitches, several tools of the art exist. More specifically U.S. Pat. No. 5,407,193 (1995) to McGinley, and U.S. Pat. No. 9,149,699 (2015) to Tai. The drawbacks of the Tai patent is the structural integrity of the baseball has been changed, and the baseball is no longer a regulation baseball. The McGinley patent has the pitcher having to memorize color codes on a finger tip indicia, different cross hatching on the indicia, and what indicia is for a right handed, or left handed pitcher to determine the pitch being thrown.

In the sport of baseball, training a right handed pitcher to pitch usually starts in their youth. The three main pitches taught through this training will be a fastball, curveball, and a change-up.

Therefore there is a need for a training baseball that has indicia for finger grip placement that shows more than the finger tip with no finger aligned correctly on the baseball. Extending the indicia makes finger placement alignment easier to understand for the youth pitcher. The baseball needs to have alphabet indentation indicia where no memorization based on color, or cross hatching markings is needed, and the structural integrity of baseball is maintained. Also, based on the light conditions the chosen pitch indicia is easier to locate on the baseball when it does not rely mainly on a color code.

Other advantages will become apparent from the following description taken with the drawings, and detailed description of the specific embodiments.

SUMMARY OF THE EMBODIMENTS

In accordance with one embodiment a baseball pitching training device having a plurality of sets of finger placement indicia for a right handed pitcher. The indicia further comprise a first set of indicia for throwing a fastball. The second indicia comprise indicia for throwing a curveball, and the third indicia comprise indicia for throwing a change-up. To distinguish between the indicia for the different pitches the indicia has colored alphabet indentation for the pitch being thrown. To further assist the pitcher the indicia is from the finger tip extending down the finger which shows the correct finger grip alignment on the baseball for a specific pitch.

Figure 1:
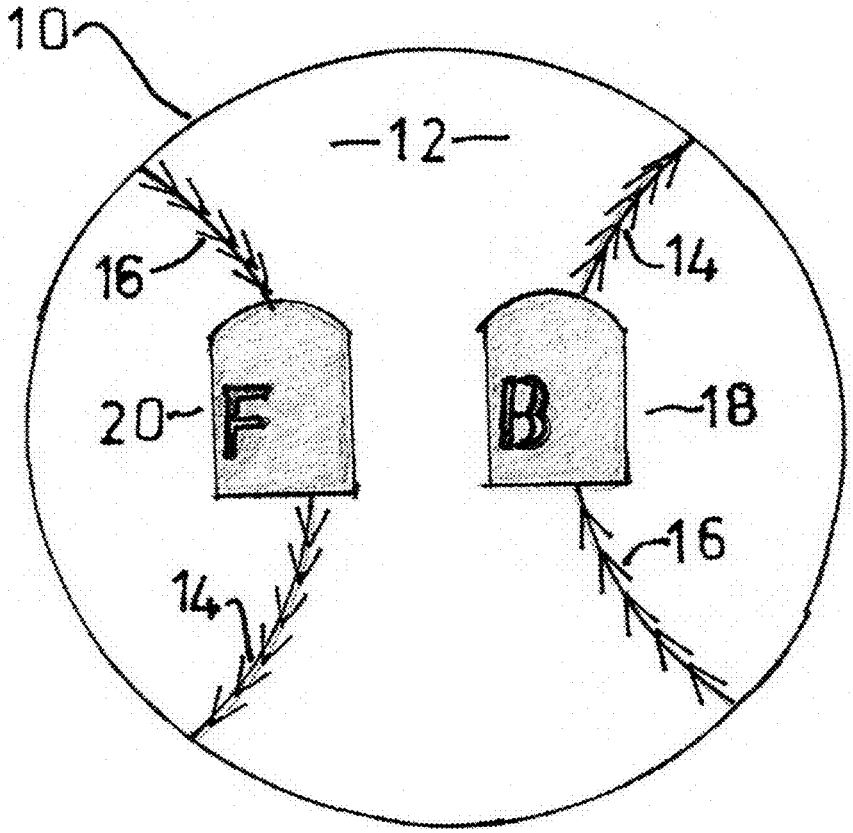
FIG. 1 is a perspective view of the baseball pitching training device illustrating finger placement for a right handed pitcher for throwing a fastball pitch.

| DRAWINGS-Reference Numerals | |
|---|---|
| 10 baseball | 12 cover |
| 14 seam | 16 stitching |
| 18 middle finger fastball indicia | 20 index finger fastball indicia |
| 22 middle finger curveball indicia | 24 index finger curveball indicia |
| 26 ring finger change-up indicia | 28 middle finger change-up indicia |
| 30 index finger change-up indicia | |

DETAILED DESCRIPTIONS OF SPECIFIC EMBODIMENTS

A baseball pitching training device comprising a regulation baseball 10 is shown having a cover 12 having seams 14 held together by stitching 16 in which the embodiment conforms in size and weight to a regulation baseball which keeps intact the structural integrity of the baseball.

Referring to FIG. 1 of the drawings indicia 18,20 represent finger placement for a fastball for a right handed pitcher. The middle finger is placed on indicia 18 and the Index finger is placed on indicia 20. Having the indicia represented by the finger tip extending down the finger aligned correctly gives the right handed pitcher a good picture of how to align the fingers to grip the baseball. The indicia is dark colored to contrast with the whiteness of the baseball making it easier to locate for finger grip placement. The indicia has colored alphabet lettering indentation making it easier to determine the pitch being thrown.

Figure 2:
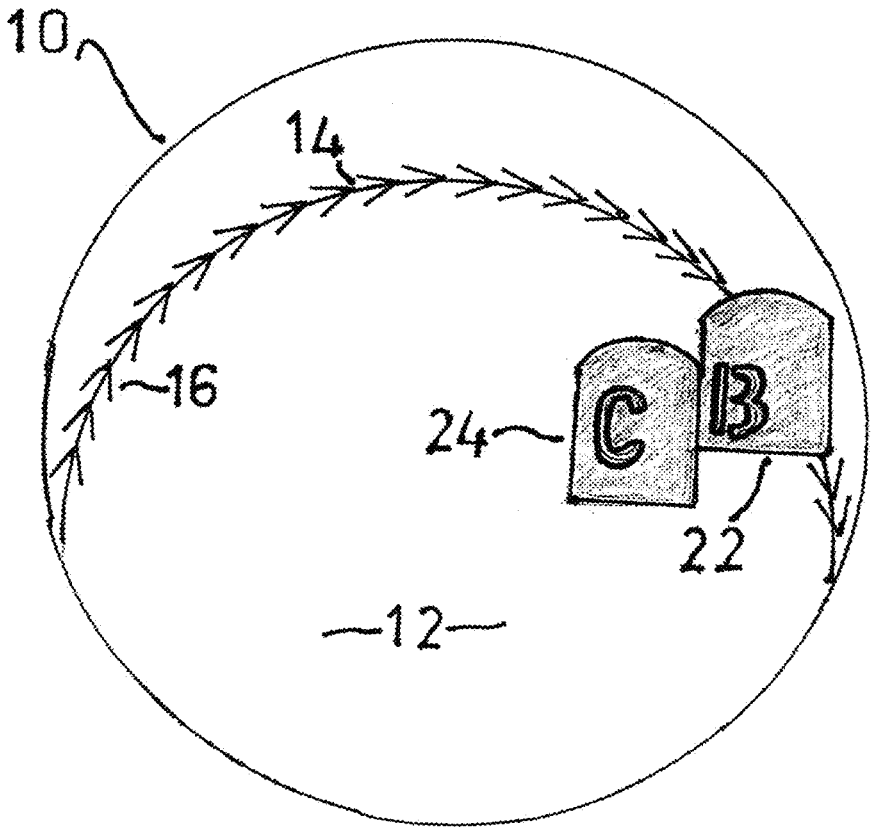
FIG. 2 is a perspective view of the baseball pitching training device illustrating finger placement for a right handed pitcher for throwing a curveball pitch.

In FIG. 2 indicia is presented for the throwing of a curveball on the baseball training device by a right handed pitcher. The middle finger is placed on indicia 22 and the index finger is placed on indicia 24. The indicia is dark colored to contrast with the whiteness of the baseball making it easier to locate for finger grip placement. The indicia has colored alphabet lettering indentation making it easier to determine the pitch being thrown.

Figure 3:
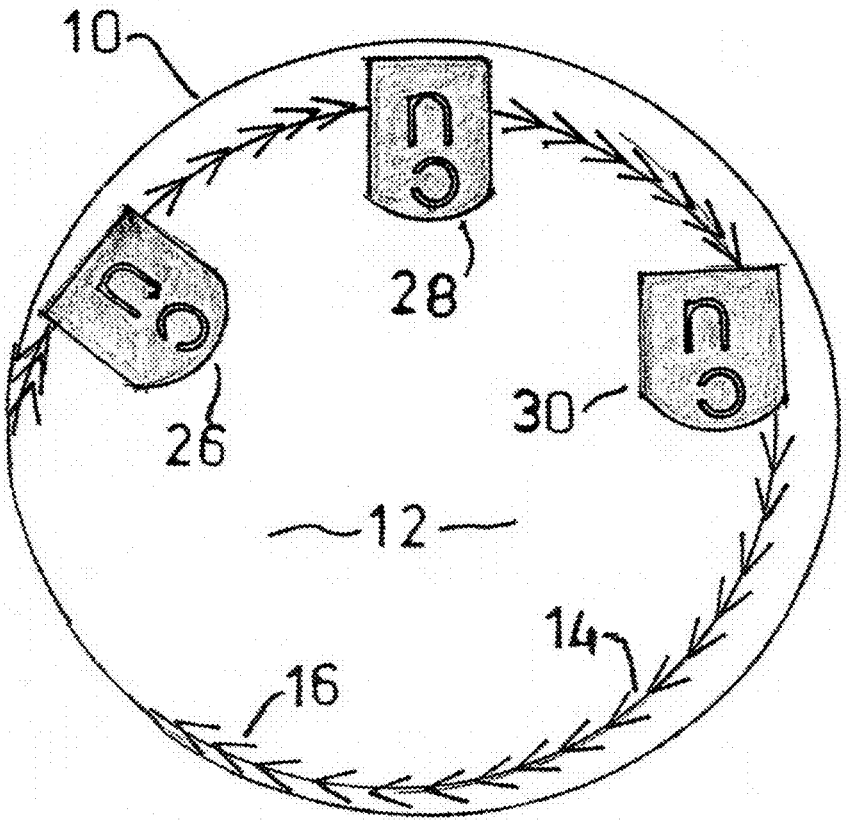
FIG. 3 is a perspective view of the baseball pitching training device illustrating finger placement for a right handed pitcher for throwing a change-up pitch.

In FIG. 3 indicia is presented for the throwing of a change-up on the baseball training device by a right handed pitcher. The ring finger is placed on indicia 26, the middle finger is placed on indicia 28 and the index finger is placed on indicia 30. The indicia is dark colored to contrast with the whiteness of the baseball making it easier to locate for finger grip placement. The indicia has colored alphabet lettering indentation making it easier to determine the pitch being thrown.

The baseball pitching training device is able to be utilized in training to teach the finger placement on the baseball to throw the fastball, curveball, and the change-up pitch by a right handed pitcher. In operation the training device is easily used because of the clarity of the indicia placed on the baseball while maintaining the structural integrity of a regulation baseball.

A baseball pitching training device has been described in terms of specific embodiments to understand the details and principles to construct the training device. A person of ordinary skills in the art appreciates that the device is made to enhance pitching skills while maintaining the structure of a regulation baseball.

I claim:

1. A baseball pitching training device for training right-handed pitchers to throw baseball pitches comprising:

a conventional baseball having an outer cover, seams extending around the baseball, and stitching extending across the seam;

a plurality of sets of indicia formed on said baseball, the sets of indicia comprising a first set of indicia showing placement of the pitcher's fingers on said baseball cover and a second set of recessed indicia positioned within said first set of indicia, wherein said second set of recessed indicia is in the shape of an alphabetic letter representing an abbreviation corresponding to a baseball pitch, and wherein each of the second set of indicia is offset from the seams and stitching of the baseball; and wherein said second set of indicia providing the pitcher with tactile input thereby enhancing tactile stimulation to the pitcher when using the baseball in order to decrease the amount of time necessary to learn a specific baseball pitch.

2. The training device as claimed in claim 1 wherein said first set of indicia are shaped to conform to a shape of a pitcher's fingertips, and wherein said first set of indicia are colored to contrast with the cover of said baseball making finger grip placement easier.

3. The training device as claimed in claim 1 wherein said first and second set of indicia improve pitch grip alignment along said seams and stitches of said baseball.

4. The training device as claimed in claim 1 wherein said alphabetic letters of said second set of indicia are colored and wherein said colored alphabetic letters further aid in identification of baseball pitches.

* * * * *